United States Patent [19]

Leong et al.

[11] 4,251,055

[45] Feb. 17, 1981

[54] JACK CONSTRUCTION

[75] Inventors: David S. Leong; Vitaly N. Levit, both of Chicago, Ill.

[73] Assignee: Templeton, Kenly & Company, Broadview, Ill.

[21] Appl. No.: 937,501

[22] Filed: Aug. 28, 1978

[51] Int. Cl.[3] ..... B66F 5/04

[52] U.S. Cl. ..... 254/2 B; 254/DIG. 1; 254/DIG. 4

[58] Field of Search ..... 254/2 R, 2 B, DIG. 1, 254/DIG. 4, DIG. 3, 93 R, 93 H, 101

[56] References Cited

U.S. PATENT DOCUMENTS

| | | | |
|---|---|---|---|
| 2,420,910 | 5/1947 | Richards | 254/93 H |
| 2,836,317 | 5/1958 | Oury | 254/2 R |
| 3,890,684 | 6/1975 | Tallman | 254/93 H |
| 4,084,791 | 4/1978 | Margueratt | 254/101 |
| 7,810,667 | 6/1931 | Larson et al. | 254/101 |

FOREIGN PATENT DOCUMENTS

| | | | |
|---|---|---|---|
| 1185871 | 3/1970 | United Kingdom | 254/93 H |

*Primary Examiner*—Robert C. Watson

*Attorney, Agent, or Firm*—Neuman, Williams, Anderson & Olson

[57] ABSTRACT

A wheeled jack construction particularly adapted for use in heavy-duty applications is provided. The jack includes a hydraulically operable piston and cylinder unit, a hydraulic fluid pump and a motive means for driving such pump. The unit is self-contained and one embodiment requires no external power source or hose connections. The provided unit may be readily wheeled by hand into place, actuated and removed from a site of use with a minimum of effort. The provided unit is flexible in operation enabling a plurality of motive means to be employed therewith.

4 Claims, 11 Drawing Figures

FIG. 6
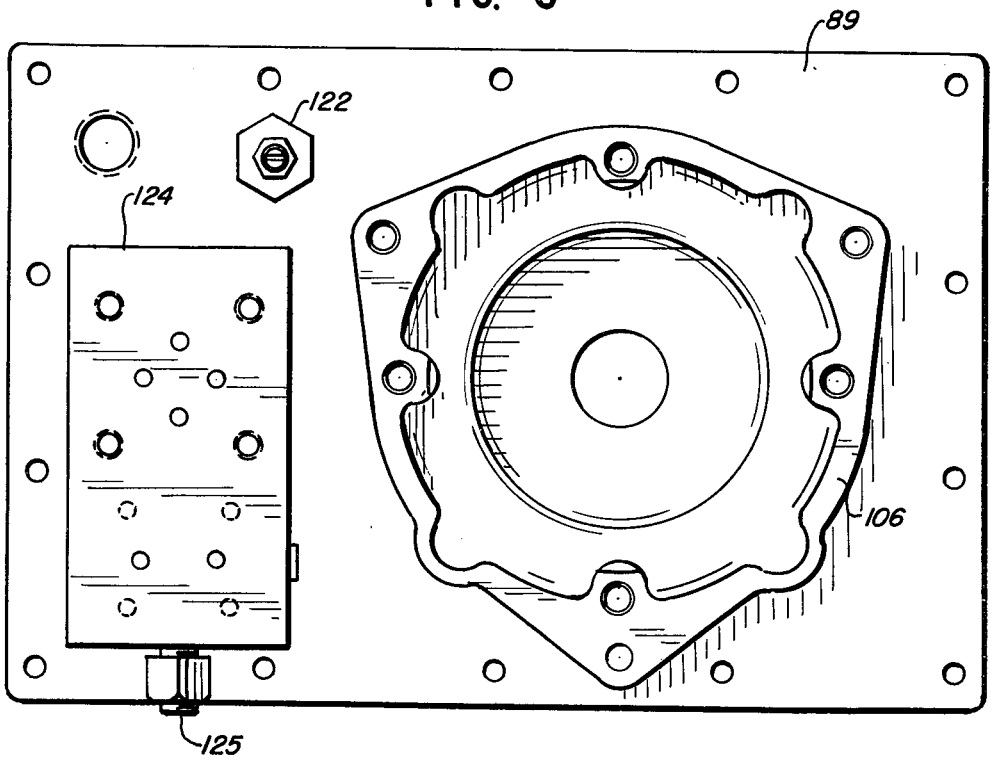
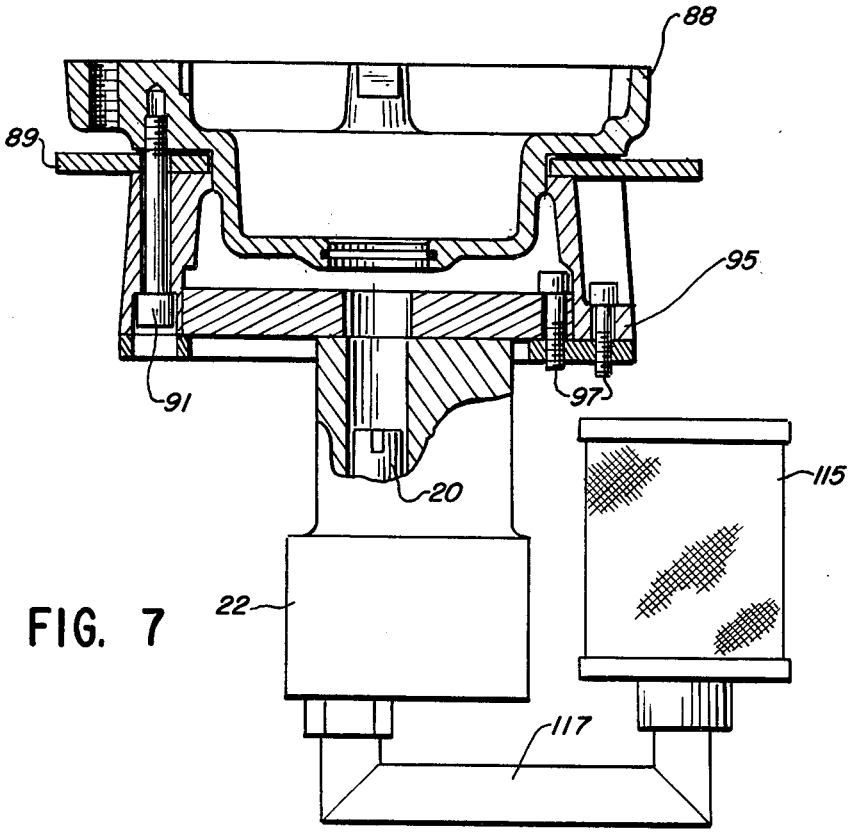
FIG. 7

FIG. 9
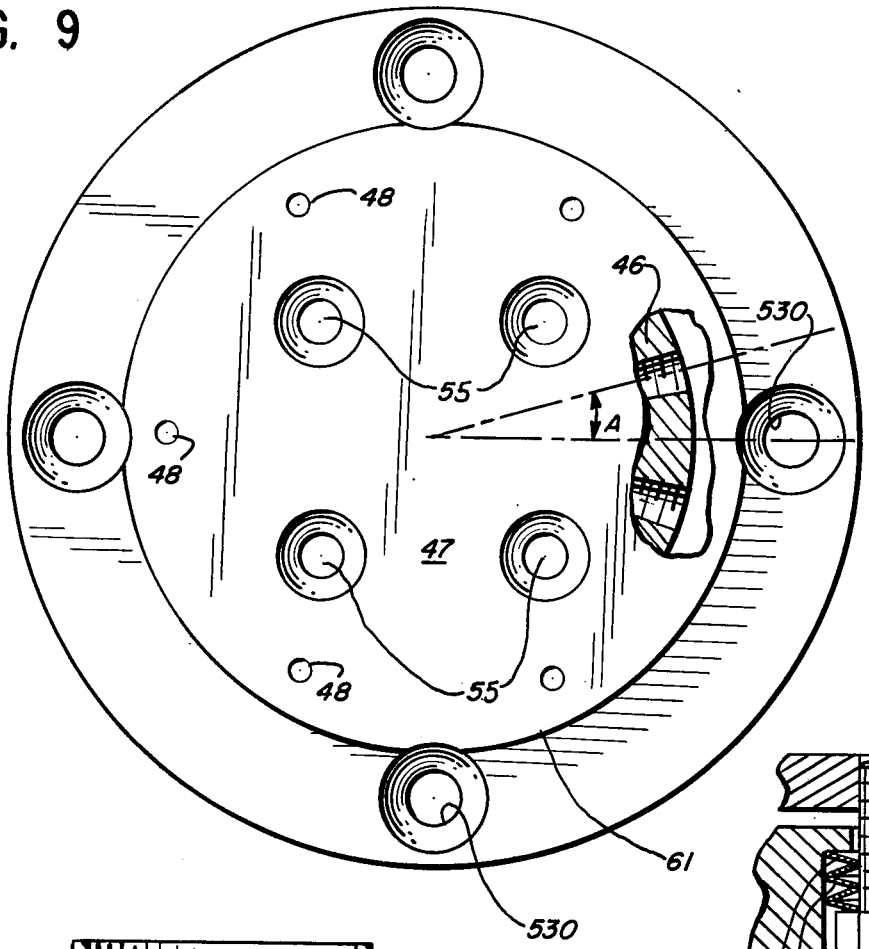
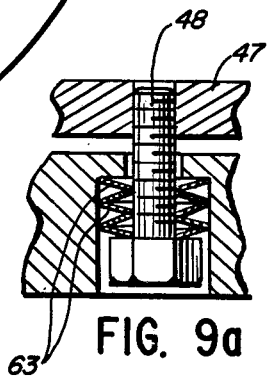
FIG. 9a
FIG. 10
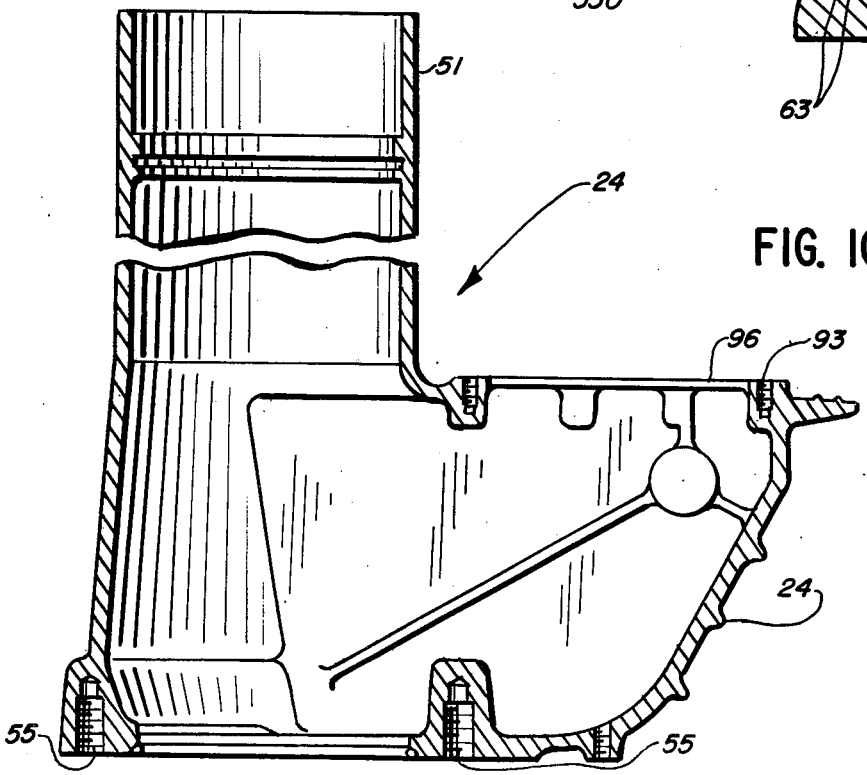

JACK CONSTRUCTION

This invention relates to a wheeled, compact jack construction and more particularly pertains to a compact jack construction adapted for heavy-duty applications in general.

Quite often in emergency situations it is desired that lifting jacks be immediately brought to a site of use for purposes of lifting heavy weights. Such emergency usually results from some equipment malfunction or accident as may occur in the mining, railway or construction industries when emergency shoring is needed.

Previously the use of hydraulic jacks in such emergency situations was oftentimes cumbersome and time consuming. These drawbacks had in the past been occasioned by the necessity of employing a plurality of discrete elements which were individually transported and assembled at the site of use. Thus, a hydraulic jack was positioned by hand, or by means of a conveying device to the precise location where lifting was to be effected; hoses were then connected to the jack cylinder hydraulic fluid inlet and outlet. A power source was then activated following making of the proper connections, to drive a pump to force hydraulic fluid into the cylinder from which a lifting piston rod or ram extended.

The conveying of the jack and auxiliary components to the site of use and assembling of the same often required long set-up time and a substantial working area to accommodate the many system components.

In accordance with this invention a compact jack construction is provided which may be readily wheeled into a position of use by a single workman. One embodiment of the provided unit is self-contained requiring no additional components or power sources.

Although self-contained gear jacks have been known in the art, such jacks were slow and subject to a variety of malfunctions including gear jamming, gear breakage in the course of use and the necessity for constant maintenance in the field.

It is an an object of this invention, therefore, to provide a self-containing hydraulic jack unit which is readily placed in position and actuated without the need for connections between components, an external power source or other preliminary operations heretofore deemed necessary with systems composed of a plurality of parts.

It is another object of this invention to provide a mobile, self-contained, heavy-duty jack unit which has a novel hydraulic fluid reservoir encompassing a piston-and-cylinder jacket unit thereby providing a compact design rendering transportation thereof by a single workman an easy matter.

It is a further object of this invention to provide a novel jack construction adapted to support heavy loads with substantially no danger of fracture of a reservoir housing.

It is a further object of this invention to provide a flexible, compact, jack construction which may be operable by way of a number of different power sources depending upon the environment in which disposed.

The above and other objects of this invention will become more apparent from the following detailed description when read in the light of the accompanying drawings and appended claims.

In one embodiment of the provided jack construction a housing is provided which is mounted on two wheels for ready movement over a supporting surface.

Mounted in the housing is a hydraulic cylinder in which a piston rod or ram is movable in a desired direction by application of hydraulic fluid to an appropriate piston surface. Also mounted on the housing is a hydraulic pump. A hydraulic fluid reservoir enabling fluid to be pumped to and from the cylinder for desired piston rod movement comprises a part of the housing shell. A self-contained power source such as an engine powered by gasoline or like fuel such as oil, benzine, etc., or a power source comprising an electric motor or an air driven motor is also mounted on the housing for appropriate actuation of the fluid pump. An electric motor is employed where a source of electrical current is readily available and an air motor where a compressed air source is available. An engine motive means renders the unit completely self-contained and independent of any need for an auxiliary power supply.

A motive means output shaft rotatably drives a hydraulic pump in communication with a reservoir of hydraulic fluid by means of an appropriate shaft connection. The hydraulic fluid passes through a check valve into a ported manifold regulated by a control valve and into a jack cylinder housing so as to elevate the piston therein to the desired height.

The provided system contains a cylinder-mounted relief valve to prevent over-pressurization of the retract side of the jack cylinder. A flow control valve provides infinite control of the retraction speed of the elevated piston of the hydraulic jack. A pilot-operated check valve is also provided which prevents accidental piston retraction in the event of hydraulic line failure. A novel shock absorbing base construction is also employed for preventing transmission of damaging shock or bending forces to the housing which is preferably formed of cast aluminum.

For a more complete understanding of this invention reference will now be made to the drawing wherein:

FIG. 6 is a top plan view illustrating a manifold and motor base adapter mounted on a mounting plate, the adapter being employed for purposes of connecting a motive means to a hydraulic fluid pump employed in the embodiments of the lifting jack made in accordance with this invention employing air and electric motor motive means;

FIG. 7 is a sectional view partly in elevation illustrating a motor base and mounting plate in assembled relationship with an adapter plate connected to a hydraulic pump employed in the lifting jack embodiment of this invention employing an engine motive means;

FIG. 9 is a bottom plan view partly broken away of a high-strength plate employed in the base of the illustrated lifting jack of this invention;

FIG. 9*a* is an enlarged fragmentary sectional view illustrating one spring connection between plate members defining the base of the provided jack of this invention; and FIG. 10 is a transverse sectional view of a reservoir housing employed in a lifting jack made in accordance with this invention.

Figure 3:
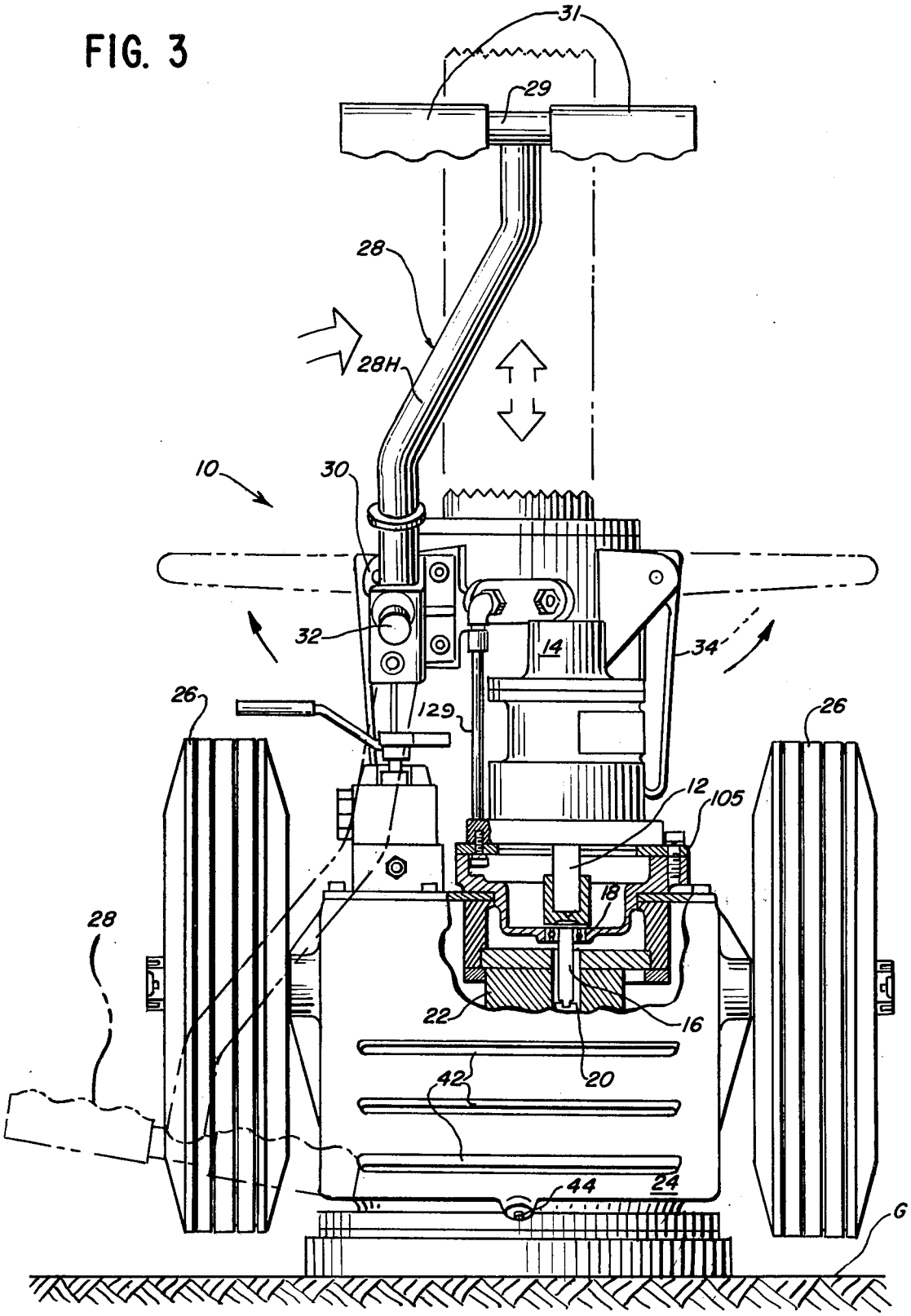
FIG. 3 is a front elevational view of a lifting jack made in accordance with this invention partly broken away for clarity of description of the drive shaft of an air motor motive means employed, and the fluid pump employed in driving the hydraulic fluid.

Referring now more particularly to FIG. 3, a wheeled lifting jack 10 is therein illustrated in front elevational view partly broken away to illustrate the connection between output drive shaft 12 of air motor 14 and adapter shaft 16 rotatably driven by output shaft 12. The adapter shaft 16 is mounted in bearing 18 and rotatably drives the input shaft 20, fragmentarily illustrated, of hydraulic pump 22 also fragmentarily illustrated and shown in greater detail in FIG. 7.

The jack 10 comprises an integral housing-reservoir 24 pivotally mounted on transverse axle 23 (FIG. 2) journaled at opposed ends in bearings 25 of opposed semi-pneumatic tires 26. Mounted on an upper portion of the housing 24 by bracket 30 is a pivotally mounted handle 28 illustrated in FIG. 3 in phantom lines in its normal, lowered position of nonuse and illustrated in full line in its elevated position of use. An operator may push or pull the jack 10 by means of handle 28 to a desired position of use. Handle 28 has transverse cross piece 29 with handle grips 31 formed for finger engagement mounted thereon. The handle 28 employs a spring-loaded pin 32 for purposes of retaining pivotal, bent portion 28H of the handle in the elevated full line position when engaged with a receiving aperture in bracket 30.

Figure 2:
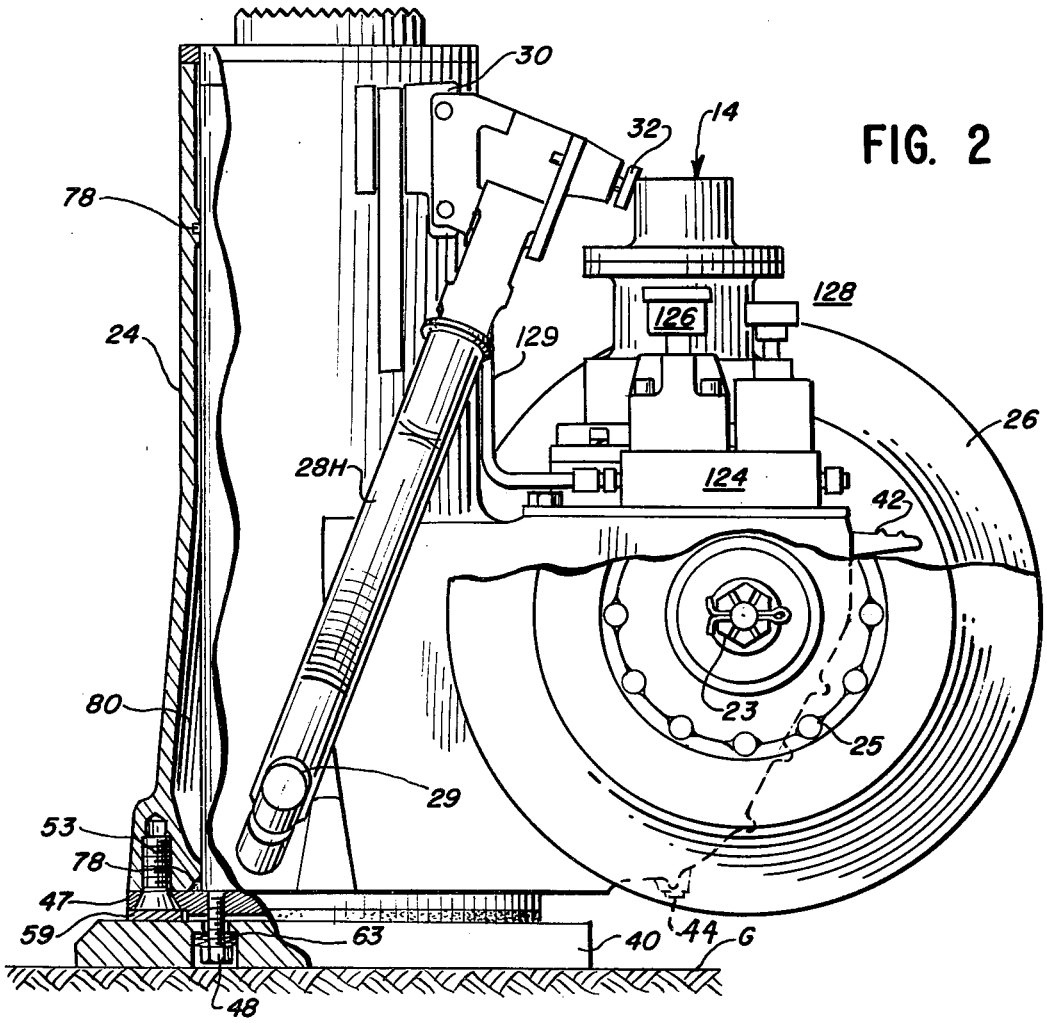
FIG. 2 is a fragmentary side elevational view partly in section and partly broken away illustrating one embodiment of a lifting jack made in accordance with this invention employing a shock absorbing base construction.

To facilitate precise placement of the jack 10, outwardly pivotal handles 34 may be employed for grasping by one or two workmen after the handles 34 have been elevated to the phantom line positions illustrated in FIG. 2. When it is desired to move the illustrated jack over the ground surface to a position of use, the opposed wheels 26 may, of course, be employed as the jack 10 is pushed or pulled by means of the handle 28. The handles 34 may be employed for fine position adjustment.

Figure 8:
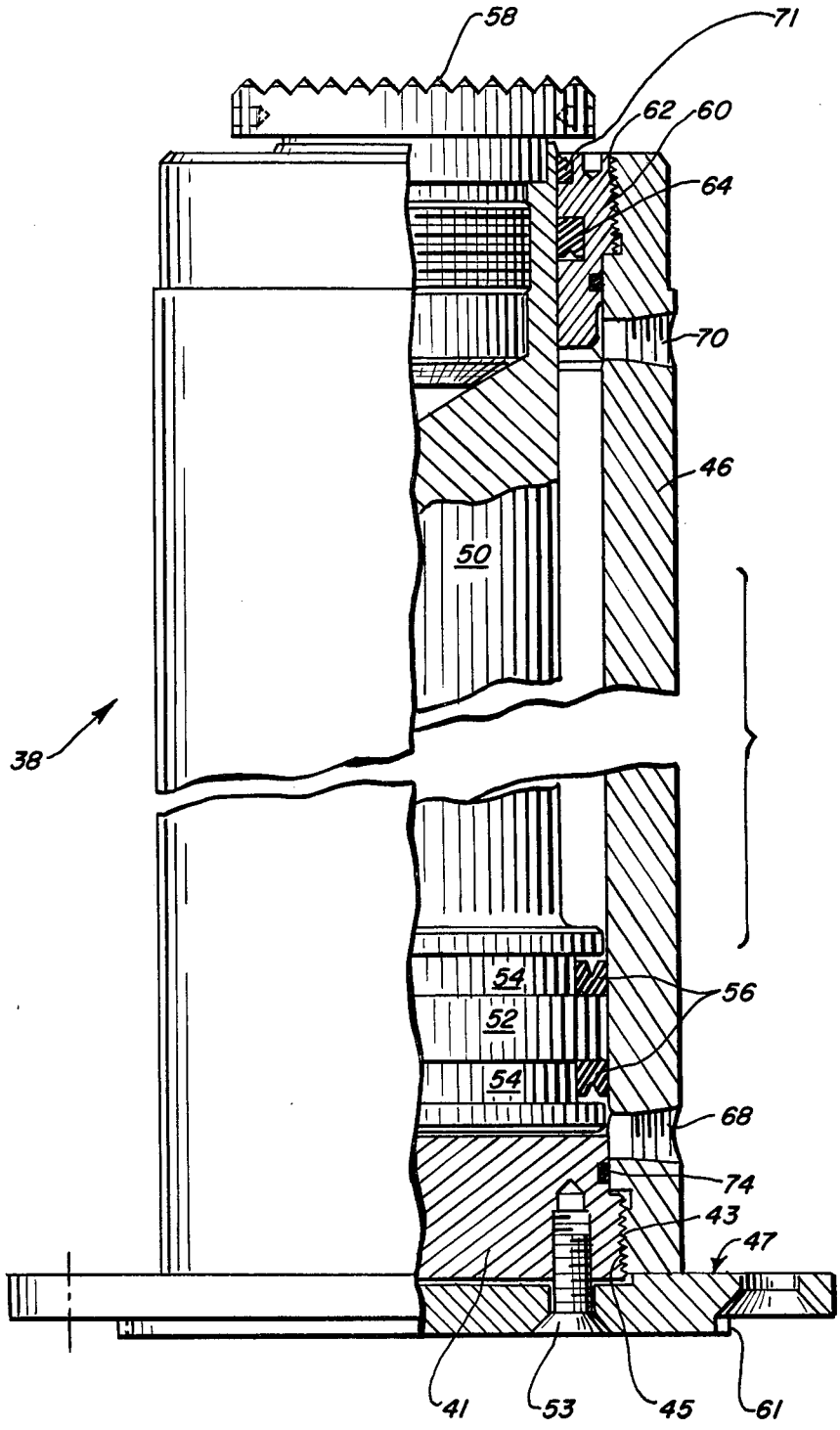
FIG. 8 is a side elevational view partly in section illustrating a lifting piston and cylinder mounted on a high-strength plate employed in a lifting jack construction made in accordance with this invention.

It will be noted from FIGS. 2 and 3 that in the normal position of jack use the housing-reservoir 24 in which the piston and cylinder assembly 38 of FIG. 8 is mounted will rest upon supporting base 40 with the opposed wheels 26 being raised off the ground level G. Accordingly, in the normal course of jack use no weight will be supported by the opposed semipneumatic tires 26. It will be noted from FIG. 3 that transverse reinforcing ribs 42 are formed in housing 24 which serve to provide transverse reinforcement for the housing-reservoir 24, and in addition provide bracing ledges against which a workman may brace his foot in the course of tilting and pushing the jack assembly 10 for purposes of obtaining initial momentum.

FIG. 8 depicts a hydraulic cylinder construction 38 which is suitably employed in the lifting jack 10 of this invention, and is of a type sold under the trademark SIMPLEX by Templeton, Kenly & Co. of Broadview, Ill. The piston and cylinder assembly 38 comprises an outer cylinder body 46 which threadably engages base cap 41. Centrally disposed of the cylinder wall 46 is a reciprocally movable piston 50 having a base disc 52 with annular recesses 54 in which seals 56 are disposed. Secured to the upper end of the piston 50 is a steel, serrated load cap 58 adapted to physically engage item to be lifted or pushed in a horizontal jack application.

A gland 60 threaded about its outer periphery, threadably engages the female threads disposed about inner periphery 62 of the upper end limit of the cylinder body 46. Annular seal 64 disposed in an annular recess of the gland 60 prevents leakage of the hydraulic fluid entering the cylinder body 46 at opening 70 to which an appropriate fitting connected to a tube (not illustrated) conveying hydraulic fluid is connected. The hydraulic fluid enters beneath the disc portion 52 of the piston 50, elevating the same.

Rod wiper 71 disposed about an inner annular cutout of the gland 60 insures that the extended piston 50 is free of foreign matter. In the course of piston retraction, hydraulic fluid enters cylinder body opening 70 from an appropriate fluid conduit connected to pump 22, urging the base 52 of piston 50 to move downwardly as the piston 50 is retracted. As illustrated in FIG. 8, base cap 41 has an outer threaded periphery 43 engaging female threads 45 defining the lower annular end limit of the cylinder body 46.

In the normal course of piston-cylinder assembly, base cap 41 is threaded in place. Annular seal 74 prevents the loss of hydraulic fluid through the base cap 41. As a structural design feature adapted to protect the cast-aluminum housing-reservoir 24 from damaging shocks with resulting fracture and hydraulic fluid loss comprises a resilient, shock absorbing base structure which is incorporated in the jack 10. Such structure comprises a high-strength, alloy steel plate 47 which is secured to the lower end periphery of the housing reservoir 24 by means of screws or bolts 53 which threadably engage spaced tapped apertures 55 of the housing 24 as illustrated in FIG. 2. The plate 47 also engages the base cap 41 by means of screws 53 engaging tapped apertures in base cap 41 as seen in FIG. 8.

The ground-engaging base of the entire jack assembly 10 in the normal course of jack operation is the lowermost aluminum plate 40 which is connected to the steel plate 47 by means of screws 48, traversing the plate 40 so as to permit movement of plate 40 relative thereto; screws 48 anchor in tapped apertures in the steel plate 47 as seen in FIG. 2.

A resilient annular washer 59 of a material of composition such as nylon is interposed the bottom of steel plate 47 and top of aluminum plate 40 as illustrated in FIG. 2. The washer is nested in an annular cutout 61 of plate 47 most clearly seen in FIG. 8. The washer in combination with five Belleville-type spring washers 63 which are stacked as illustrated on the shank of each screw 48 form a buffer or bumper spring tending to absorb forces imparted to the base aluminum plate 40 preventing transmission of such faces to the reservoir housing 24. The enlarged view of FIG. 9*a* depicts the five apertured frusto-conical, stacked spring washers of FIG. 2 mounted on the shank of screw 48. Thus, the washer which is of high tensile strength and the screw-washer connection between the plates 40 and 47 act as a shock absorber preventing damage to housing 24 as when the jack is subjected to a shock load during an accidental drop or in the event the jack aluminum base 40 is unevenly supported on a supporting surface during jack use.

The steel plate 47 is four to five times stronger than aluminum and thus will restrain greater loads and deflect minimum amounts in transferring stresses to the housing 24. In actual use the nylon pad would be first compressed after which washers 63 will compress upon a shock force being imparted to the jack supporting base 40. Even should base 40 fracture, the jack remains operable with no damage to housing 24 by virtue of the high-strength steel plate 47.

During assembly of the shock absorbing base components, after base cap 41 is threaded to the bottom of cylinder 46, the four central flat head cap screws 53 are hand tightened only. These screws secure the high-strength steel plate 47 to the cap base. The plate 47 and cap base 41 are then rotated as a unit counter clockwise within one-quarter turn until the angle A in FIG. 9 is $16\pm1$ degrees. The screws 53 are then fully tightened. Screws 53 passing through openings 530 in the outer periphery of plate 47 engage tapped openings 55 (FIG. 10) disposed in the outer periphery of housing-reservoir 24. Subsequently, the lowermost base plate 40 may be secured to the steel plate 47 by means of the washer-bearing screws 48.

The piston and cylinder assembly 38 of FIG. 8 is receivable in cylindrical portion 51 of the housing-reservoir 24 illustrated in FIG. 10, in the manner most clearly illustrated in FIG. 2. It will be noted from FIG. 2 that O-rings 78 or equivalent sealing means are interposed outer peripheral portions of the cylinder wall 46 of the cylinder 38 and the inner periphery of the housing reservoir portion 51. Accordingly, interval 80 most clearly seen in FIG. 2 functions as a portion of the hydraulic fluid reservoir, thereby making dual, optimum use of the housing 24.

As has previously been noted, it is an object of this invention to provide a self-contained lifting jack which may be readily moved to a site of use in a minimum of time and with a minimum of assembly operation. Heretofore in the utilization of hydraulic jack units, separate power sources were connected to piston and cylinder assemblies by means of interconnecting hoses, and only after a minimum assembly time of some duration has transpired was the piston and cylinder unit in an operable condition. Quite often in an emergency situation it is critical to have the lifting jack moved into a position of use and rendered operable immediately so as to perform desired lifting functions.

Figure 5:
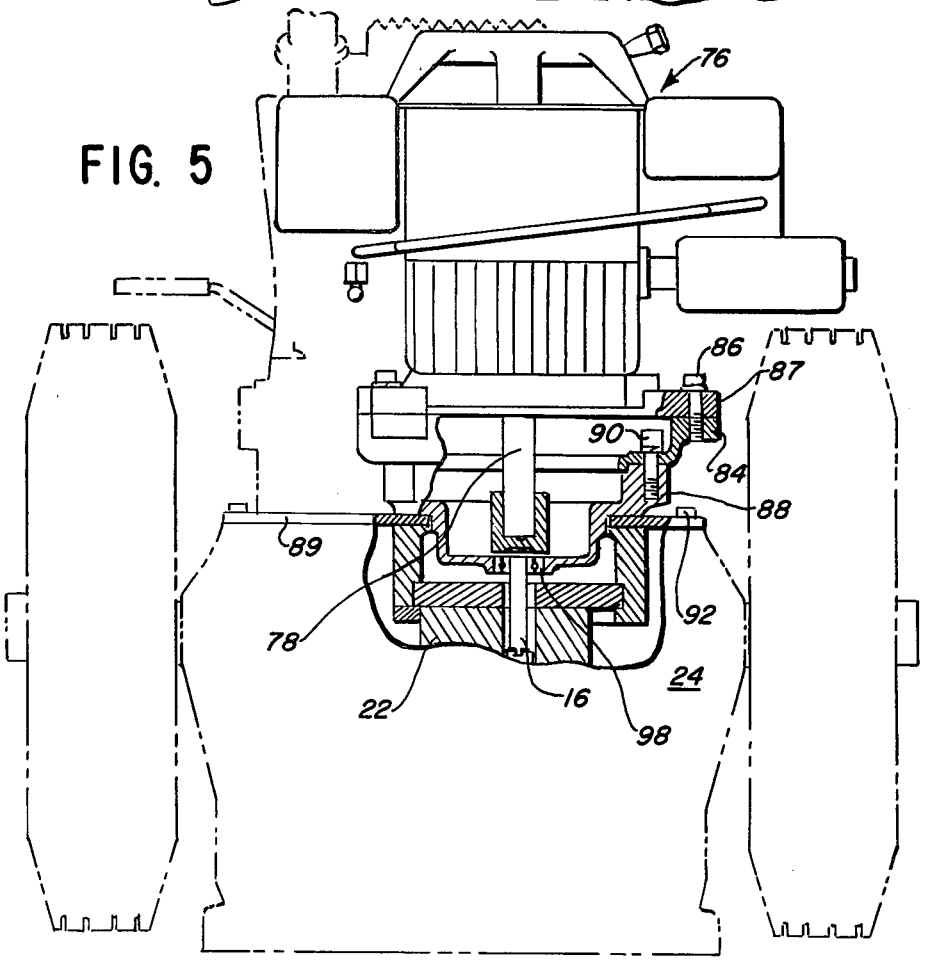
FIG. 5 is a view similar to that of FIG. 4 employing a gas burning engine as the motive means for driving the illustrated hydraulic pump, fragmentarily shown in sectional view.

Referring more particularly to FIG. 5, an embodiment of a lifting jack made in accordance with this invention is illustrated in which gasoline-powered engine 76 comprises the motive means employed for driving the hydraulic pump 22. Output drive shaft 78 of the gas powered engine 76 rotatably drives the pumping elements of the hydraulic pump 22 by means of shaft extension 16. The gasoline engine employed may be of a type commercially available and may comprise a seven horsepower engine such as that sold under Model No. 170702-1016-01 by Briggs and Stratton of Milwaukee, Wis. The gasoline engine 76 is completely self-contained and requires no exterior power source whereby it may be completely, independently operable on the job site without the necessity for connection to a source of power such as electricity or compressed air.

One of the advantageous features of this invention comprises the fact that the hydraulic pump 22 may be rotatably driven by a variety of power sources including the illustrated gasoline engine 76. It will be noted from FIG. 5 that the gasoline engine has a flange 87 mounted on adapter plate 84 by means of attaching bolts 86 or the like. Adapter plate 84 in turn engages base 88 by means of securing bolts 90 or the like.

It is seen, therefore, that the base 88 comprises a motive means adapter enabling the gasoline engine 76 to be mounted above the hydraulic pump 22 and by means of the shaft extension 16 drive said hydraulic pump. The adapter base 88 is secured to mounting plate 89 by screws 91 (FIG. 7) or equivalent securing means. The assembly is supported on surface 96 (FIG. 10) of reservoir housing 24. The housing tapped apertures 93 (FIG. 10) engage the securing screws 92 or the like for locking mounting plate 89 in fixed position. Shaft extension 16 in FIG. 5 is rotatably mounted in bearing 98 in the course of driving the pumping elements of hydraulic pump 22.

Pump 22 is connected to mounting plate 89 by pump adapter 95 which is secured to plate 89 with the assistance of screws 91 and secured to pump 22 of means of securing means 97 as seen in FIG. 7.

The pump 22 may be of a type known in the art such as that sold under Model No. 28354 by the Owatonna Tool Company of Owatonna, Minn. Such pump has a speed of 3450 RPM and has a fluid capcity of over 460 cubic inches at 0 psi and a capacity of 120 cubic inches at 10,000 psi.

Figure 4:
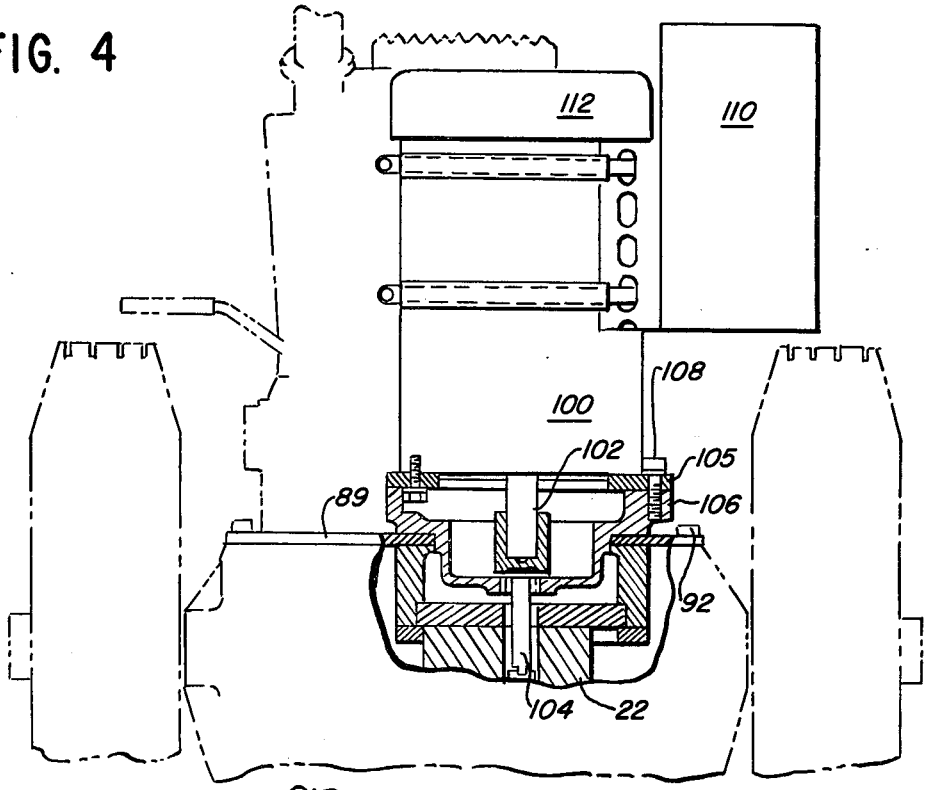
FIG. 4 is a fragmentary elevational view partly in phantom line illustrating an electric motor motive means and its connection to the hydraulic pump employed in one embodiment of the lifting jack of this invention.

The versatility of the provided jack construction is further evident from FIG. 4 of the drawing wherein electric motor 100 is illustrated as the motive means for driving the hydraulic pump 22 employed in the subject jack construction. Electric motor output drive shaft 102 is connected by means of extension 104 to the pumping elements of the hydraulic pump 22. It will be noted that flange 105 is of different configuration from flange 87 employed with the engine of FIG. 5 and is utilized in the assembly of FIG. 4. The flange 105 is bolted to an adapter base 106 of somewhat different configuration from adapter base 88 of FIG. 5 by means of bolts 108 or the like. In all adapter and motive means embodiments a fluid-tight assembly is assured in which leakage of hydraulic fluid to the housing exterior is prevented.

Motor 100 may comprise a 115/230 volt 60 cycle single phase or 230/460 three phase motor. Such motors have been sold in the past by Templeton, Kenly & Co. in their portable hydraulic power systems under the trademark CHARGER. In FIG. 4 an oil tight control box 110 of a type known in the art is depicted in conjunction with the motor 100 and its cover 112.

The lifting jack construction of FIG. 2 is the same basic construction as the lifting jacks of FIGS. 4 and 5 with the exception that the motive means for driving the hydraulic pump 22 comprises the air motor 14 which is actuated by compressed air. Air motors may be employed advantageously in hazardous environmental situations, as they are substantially explosive-proof and burnout-proof, and in general cooler running than the counterpart electric engines. Air motor 16 of FIG. 2 may be of a type commercially available and manufactured by the Gast Manufacturing Corporation of Benton Harbon, Mich. and sold under Model No. 8AM-NRV-28A. Such motor utilizes precisely the same motor mount 106 as is illustrated in FIG. 4 for use in conjunction with the electric motor 100. The remaining mounting structure is precisely the same as that described in connection with the jack construction of FIG. 4.

FIG. 6 illustrates the pump mounting assembly comprising the plate 89 and adapter base 106 utilized with the electric motor 100 of FIG. 4 and the air motor 14 of FIGS. 2 and 3. It will be noted from FIG. 6 that in addition to having the adapter 106, manifold 124 is also mounted thereon. Mounting plate 89 supports the hydraulic pump assembly including the hydraulic pump 22 and filter 115 connected with the pump by means of tubular conduit 117 (see FIG. 7). The filter 115 is disposed within the enlarged reservoir portion of the housing-reservoir 24 illustrated in FIG. 10 of the drawing. As the elements of the pump 22 are rotatably driven by the output shaft of the overlying motive means, hydraulic fluid passes through the filter into the pump 22. The mounting plate 89 and thus the pump elements are supportably secured to the top surface 96 of the reservoir-housing 24 by securing means such as screws or the like. The hydraulic fluid is pumped into an entering connection of manifold 124 and passage therethrough is regulated by a control valve such as valve 126 of FIGS. 1 and 2. Hydraulic fluid may be drained when desired from reservoir housing 24 through plug 41 illustrated in FIGS. 2 and 3.

Figure 1:
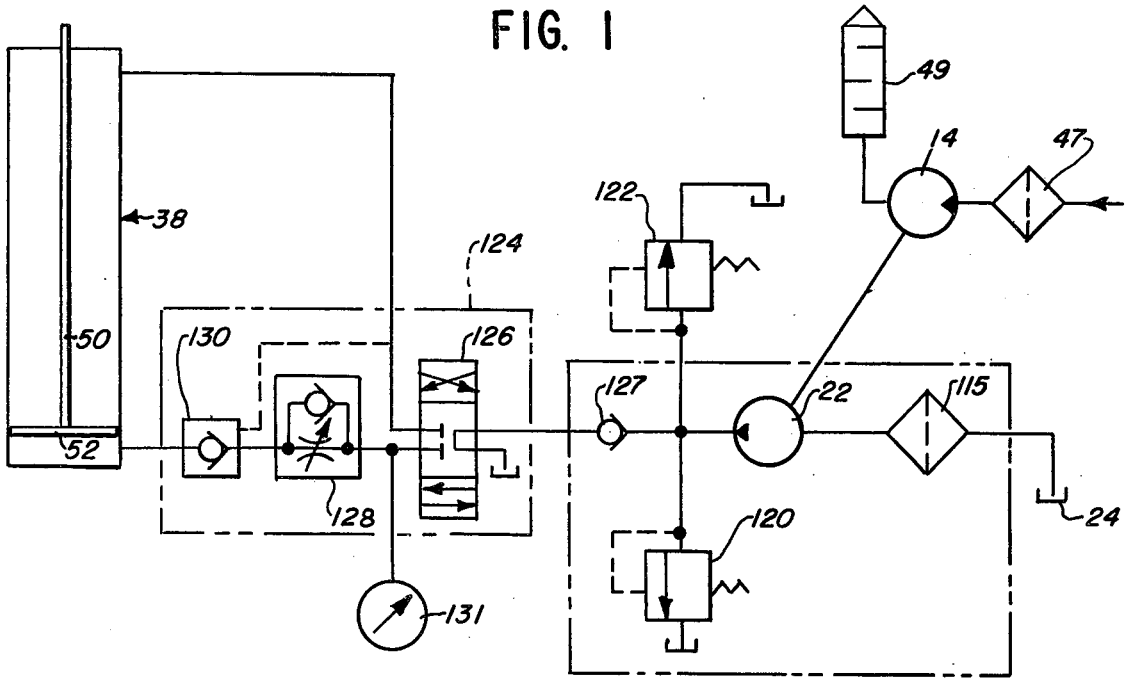
FIG. 1 is a schematic flow diagram illustrating the path of hydraulic fluid flow through one embodiment of a jack construction made in accordance with this invention.

Referring now more particularly to FIG. 1 a flow diagram of hydraulic fluid in the provided jack construction is schematically illustrated, assuming that the motive means comprises the air motor 14 of FIG. 2. Hydraulic fluid passes from the reservoir 24 through filter 115 into hydraulic pump 22. The hydraulic pump 22 is driven by air motor 14. Air passes into air motor 14 through air filter 47. Muffler 49 is connected to the air motor 14. Disposed in the reservoir 24, together with the hydraulic pump 22, is a relief valve 124 which obviates the development of excessive pressures in the pump 22. Also in communication with the hydraulic fluid line extending from hydraulic pump 22 is an externally adjustable relief valve 122 illustrated in FIGS. 2 and 6.

Hydraulic fluid passes from the pump 22 through the check valve 127. Following passage through the check valve 127 the hydraulic fluid passes through the manifold plate 124 illustrated in FIG. 6 on the mounting plate 89.

The manifold plate 124 comprises a ported plate in which passage of the hydraulic fluid therethrough is controlled by control valve 126 comprising a four-way valve. Control valve 126 controls the extension and retraction of the piston 50 of the piston and cylinder assembly 38 of FIG. 8.

Following passage through the manifold plate 124, the hydraulic fluid passes through flow-control valve 128 the function of which is to control the speed of hydraulic fluid passage to the reservoir in the course of piston retraction. In the course of piston extension, the flow control valve 128 is in the free-flow, fully opened position. Valves 126 and 128 are illustrated in elevation in FIG. 2 of the drawing, mounted on top of the manifold plate 124. As an additional safety precaution, a pilot-operated check valve 130 is mounted directly on the cylinder 46 of the piston and cylinder unit 38. Hydraulic fluid then enters the unit 38 beneath the piston 52. Gauge 131 illustrated in FIG. 1 enables the pressure of the hydraulic fluid in the piston and cylinder unit 38 to be ascertained externally of between the cylinder wall of the piston and cylinder unit and the surrounding reservoir housing as a reservoir for the hydraulic fluid which is pumped in the normal course of extending and retracting the piston effecting the lifting of said unit during the extension stroke of the piston.

In addition to being in fluid communication with the cylinder ports 68 and 70 (FIG. 8), as by means of tubular connection 129 of FIG. 2 and FIG. 3, the various orifices of plate 124 are in fluid communication with the foregoing valves and gauges for appropriate control and sensing of the hydraulic fluid employed in the jack 10.

It is seen from the foregoing, therefore, that a novel lifting jack construction has been provided which is adapted to be readily moved to a desired site of use with a minimum amount of time and with a minimum amount of maneuvering by a single operator. The provided lifting jack requires no connections between motive means, hydraulic pumps and the piston and cylinder unit employed in that it comprises a fully connected unit ready to operate. In those instances in which the engine construction of FIG. 5 is employed, there need be no concern about an external power source to drive the hydraulic pump unit 22. The provided jack may, of course, be employed in a horizontal position for pushing purposes as well as in the vertical position for lifting.

The various pump power sources employed comprising the air motor, electric motor and engine may be readily interchanged with the utilization of the respective adapter plates. Piston and cylinder units 38 may be varied and utilized with the same reservoir housing. The only concern is that the piston cylinder units employed be of such size as to be able to effect a desired hydraulic seal with the reservoir housing. As above noted, one of the aspects of the invention comprises the utilization of the interval between the cylinder wall of the piston and cylinder unit and the surrounding reservoir housing as a reservoir for the hydraulic fluid which is pumped in the normal course of extending and retracting the piston effecting the lifting action.

It is thus seen, therefore, that the provided jack is fully assembled, heavy duty, readily placed in operation and readily maneuverable, and yet may comprise an extremely heavy duty jack capable of lifting or pushing heavy loads.

The novel base assembly prevents shocks which might damage housing reservoir 24 preferably formed of aluminum from being transmitted thereto. Such shocks are absorbed by the cushion washer and spring washer assemblies above described.

It is also seen from the foregoing that the provided lifting jack of this invention may utilize a variety of motive means in varying use situations. In those instances which the source of electricity is readily available an electric motor 100 would be most advantageous. In those instances where it is desired to use lifting jack 10 in rather remote areas having no electrical source of energy or compressed air line, the jack construction of FIG. 5 would be most advantageous as the unit is completely self-contained and independent of the need for any external power source. In those hazardous situations where a compressed air line is available the jack construction of FIG. 2 would be the most desirable.

Regardless of the specific motive means employed, the lifting jack will employ the hydraulic piston-cylinder unit 38 of FIG. 8 and its attendant advantages. Such hydraulic units are capable of lifting great weights, and are substantially trouble-free in the normal course of operation, being free from jamming and highly resistant to breakage.

It is believed that the foregoing detailed description has made apparent a number of modifications of the provided jack constructions which modifications will remain within the ambit of the invention disclosed. This invention, therefore, is to be limited only by the scope of the appended claims.

What is claimed is:

1. A heavy-duty, mobile jack construction comprising a housing; a piston and cylinder unit mounted in said housing; the piston of said unit being reciprocally movable relative to said cylinder by hydraulic pressure; a pump disposed in said housing for pumping hydraulic fluid; conduit means for conveying hydraulic fluid from said pump to the cylinder of said unit; motive means mounted on said housing for driving said pump; said housing defining a hydraulic fluid reservoir encompassing at least a portion of said piston and cylinder unit; base means for said cylinder in fluid-sealing engagement therewith; a high-strength plate fixedly secured to said base means and the lower periphery of said housing whereby said housing, base means and plate assume a rigid assembly in relatively immovable relationship; said jack having a lowermost supporting plate underlying said jack construction for supporting said jack on a support surface in the normal course of jack use; said lowermost plate being resiliently movable relative to the remainder of said jack construction and being secured to said high-strength plate; said securing means having a plurality of spring washers mounted thereon for resiliently separating said lowermost plate from said high-strength plate.

2. The jack construction of claim 1 in which a resilient washer is interposed said lowermost plate and said high-strength plate and said high strength plate is annularly relieved to interfit therewith.

3. A heavy-duty, mobile jack construction comprising a housing formed of a lightweight material of fabrication; a piston and cylinder unit mounted in said housing; said piston of said unit being reciprocally movable relative to said cylinder by hydraulic fluid pressure; a pump disposed in said housing for pumping hydraulic fluid; conduit means for conveying hydraulic fluid from said pump to said cylinder; motive means requiring no external power source mounted on said housing for driving said pump; a hydraulic fluid reservoir in said housing encompassing at least a portion of said piston and cylinder unit; a shock-absorbing base construction connected to the lower periphery of said housing for dissipating forces imparted to said base construction and preventing the same from being imparted to said housing; said shock-absorbing base construction comprising a high-strength plate resistant to bending, secured to the bottom of said housing; a lowermost support plate on which said jack rests in the normal course of jack use; means resiliently spacing said lowermost plate and said high-strength plate comprising a nylon washer and spring means interposed with said high strength plate and said lowermost plate, said spring means comprising spring washers mounted on cap screws traversing said lowermost plate and anchored in said high strength plate.

4. The jack construction of claims 1 or 3 in which said motive means comprises a gasoline engine and said housing is formed of cast aluminum.

* * * * *

UNITED STATES PATENT AND TRADEMARK OFFICE

CERTIFICATE OF CORRECTION

PATENT NO. : 4,251,055

DATED : February 17, 1981

INVENTOR(S) : David S. Leong and Vitaly N. Levit

It is certified that error appears in the above-identified patent and that said Letters Patent are hereby corrected as shown below:

Column 1, line 41, cancel "an" (second occurrence)

Column 7, line 38, change "120" to -- 124 --

Column 10, line 26, (Claim 3) cancel "with"

Signed and Sealed this

*Twenty-sixth* Day of *May 1981*

[SEAL]

*Attest:*

RENE D. TEGTMEYER

*Attesting Officer*

*Acting Commissioner of Patents and Trademarks*